United States Patent [19]

LeGlue

[11] Patent Number: 4,506,867

[45] Date of Patent: Mar. 26, 1985

[54] JACKING APPARATUS HAVING A FAST REPOSITIONING STROKE

[75] Inventor: Michael J. LeGlue, New Orleans, La.

[73] Assignee: McDermott Incorporated, New Orleans, La.

[21] Appl. No.: 331,737

[22] Filed: Dec. 17, 1981

[51] Int. Cl.[3] ..... B66F 1/08

[52] U.S. Cl. ..... 254/108; 91/519

[58] Field of Search ..... 254/105, 106, 107, 108, 254/109, 110, 111, 112, 14, 134.6, 93 R; 91/519, 530, 217, 167 R

[56] References Cited

U.S. PATENT DOCUMENTS

| | | | |
|---|---|---|---|
| 2,517,164 | 8/1950 | Arps | 91/519 |
| 2,962,001 | 11/1960 | Morton et al. | 91/519 X |
| 3,170,379 | 2/1965 | Dempster | 91/519 |
| 3,680,713 | 8/1972 | Langley | 91/519 X |
| 4,007,915 | 2/1977 | Chambers | 254/108 |
| 4,024,794 | 5/1977 | Grubb | 91/519 X |
| 4,030,699 | 6/1977 | Heimke | 254/108 |
| 4,296,677 | 10/1981 | Little et al. | 91/519 X |

*Primary Examiner*—Frederick R. Schmidt
*Assistant Examiner*—Steven P. Schad
*Attorney, Agent, or Firm*—Robert J. Edwards; James C. Simmons

[57] ABSTRACT

A jacking apparatus and method for effecting movement of loads. At least two double-acting hydraulic cylinders including a first and a second cylinder arranged in tandem provide increased force for a power stroke of the apparatus. Hydraulic fluid pressure is provided at a predetermined flow rate to the group of hydraulic cylinders. Substantially all of the predetermined flow rate of hydraulic fluid is routed to the first hydraulic cylinder to provide increased speed for a repositioning stroke of the apparatus.

7 Claims, 6 Drawing Figures

JACKING APPARATUS HAVING A FAST REPOSITIONING STROKE

This invention relates to jacking apparatus for effecting movement of loads. More particularly, this invention relates to jacking apparatus utilizing hydraulic means to move a load.

At various times during industrial projects there exists a need to move heavy loads from one location to another. For example, in marine applications, it may be desirable to move a heavy boat or an off-shore oil platform along launchways for launching of the boat or platform into the water. In such a case, a jacking apparatus utilizing hydraulic cylinders may be used to apply the force necessary for movement of such a load. In a typical jacking arrangement, the load may be connected through various interconnecting structure to a piston rod which piston rod is also attached at the opposite end thereof to a piston which is contained within a cylinder. For the purposes of this specification and the claims, unless otherwise specified herein, a "cylinder" is not meant to include a piston or piston rod portion. The cylinder is anchored at one or more anchor points in or on the structure supporting the apparatus to prevent its movement in a direction opposite to the direction of desired movement of the load for a power stroke of the piston. As used herein, the term"power stroke" refers to a piston stroke which effects movement of a load. During a power stroke, the piston moves since the cylinder is held stationary at the anchor points. This is distinguished from a "repositioning stroke" which refers to movement of the jacking apparatus in preparation for a power stroke. During a repositioning stroke, the cylinder moves and the load and piston remain stationary.

When hydraulic fluid under pressure is supplied to the cylinder for the power stroke, the fluid applies force between one side of the piston and the corresponding opposite cylinder wall. Since the cylinder is anchored at one or more anchor points to prevent its movement in the direction in which it is being urged by the pressure of the hydraulic fluid against the cylinder wall, the resulting movement of the piston effects movement of the load in a desired direction. The load is thus moved a finite distance in the desired direction equal substantially to the distance in which the piston travels during the power stroke.

In a common jacking arrangement of this type, provision is made for disengaging the jacking apparatus from the anchor points for a repositioning stroke. Hydraulic fluid pressure is applied between the other side of the piston and the corresponding opposite cylinder wall for the repositioning stroke. Since the apparatus is usually substantially lighter than the load and therefore offers substantially less resistance, the hydraulic fluid pressure acting against the cylinder wall effects movement of the cylinder and remainder of the apparatus (except, of course, for the piston and that portion of the apparatus attached to the piston) in the same direction as the load was previously moved a distance equal substantially to the same distance the load was previously moved. At this point another anchor point or set of anchor points is engaged thereby readying the apparatus for another power stroke wherein the load may be moved another finite distance in the desired direction.

The cylinder and hydraulic fluid pump arrangement may be sized for a maximum load during the power stroke at a specified speed. Cylinder and hydraulic fluid supply arrangements for typical jacking apparatus of the prior art apply hydraulic fluid pressure to one side of a piston for a power stroke and to the other side of the piston for a repositioning stroke with fluid on the respectively opposite sides of the piston being returned to a sump on each respective stroke. Since the jacking apparatus is usually substantially lighter than the load to be moved, during the repositioning stroke the available force for movement of the jacking apparatus is substantially greater than the force which is needed to move the jacking apparatus. However, the speed of such a typical jacking apparatus on the repositioning stroke is still limited since the speed of the repositioning stroke as awell as the speed of the power stroke is dependent upon the rate of flow of hydraulic fluid into the cylinder.

A jacking operation for loading or launching a huge off-shore oil platform may require thirty or forty hours which time is largely taken up by a series of power and repositioning strokes. Such an operation may utilize several tugboats and cranes. In all, perhaps thirty or forty people are required for such a jacking operation. If the time required for each repositioning stroke of such an operation were reduced substantially such as by about half, the result would be a savings of many hours of time and cost savings of many thousands of dollars.

It is, therefore, an object of this invention to provide a jacking apparatus which has an hydraulic cylinder fluid supply arrangement which provides a maximum speed capability to a repositioning stroke for a given pump capacity so as to reduce the time required for each repositioning stroke.

The above and other objects, features, and advantages of this invention will be apparent in the following detailed description of the preferred embodiments thereof which is to be read in connection with the accompanying drawings.

Figure 1:
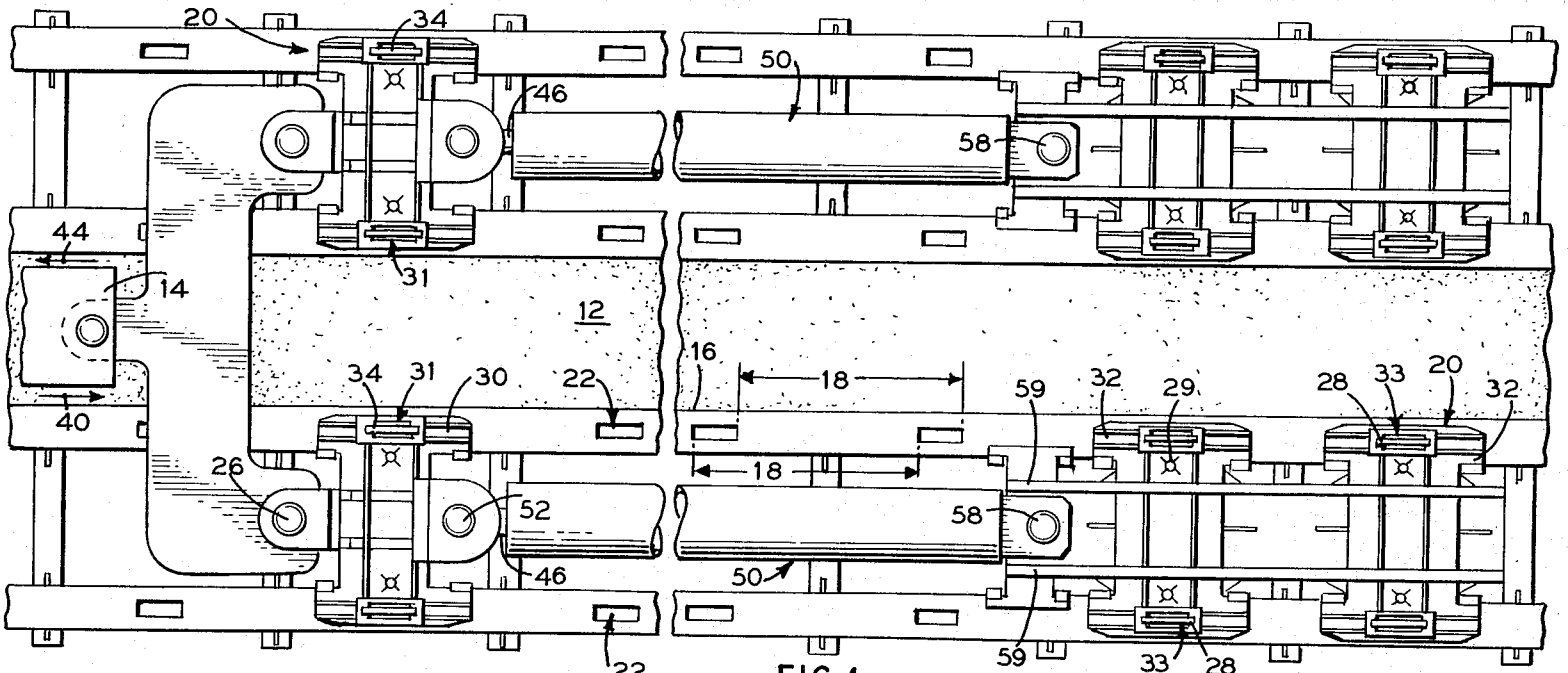
FIG. 1 is a plan view of a jacking apparatus which embodies this invention.
Figure 2:
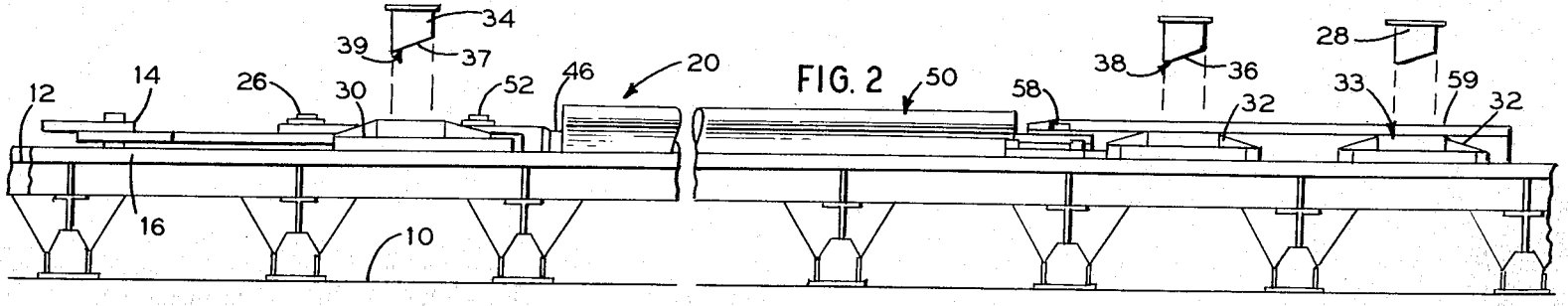
FIG. 2 is an elevation view of the jacking apparatus of FIG. 1.

Referring to FIGS. 1 and 2, there is shown a barge deck 10 upon which is erected a support structure such as a set of launchways 12 (only one of which is shown) for supporting and moving a load 14 such as a boat or off-shore oil platform. The launchways 12, which may have composed of a material such as Teflon resin having a low coefficient of friction surfaces to aid in sliding movement of a load, extend in a direction of desired movement of the load (either from left to right or from right to left in FIGS. 1 and 2). Each launchway12 supports a pair of jacking apparatus 20 as well as the load 14 for sliding movement in a direction along one or more members such as jacking beams 16. Hereinafter, this direction (either from right to left or from left to right in FIGS. 1 and 2) will be referred to as a longitudinal direction. A plurality of anchor points such as slots 22 vertically oriented in jacking beams 16 provide a means for anchoring each jacking apparatus 20 against movement during a power stroke thereof. Jacking beams 16 preferably extend alongside of and are preferably slightly higher than the respective launchway 12 to aid in guiding the load 14. Corresponding edges of the slots 22 of each beam 16 are spaced apart in a longitudinal direction a distance illustrated at 18 in FIG. 1 which is preferably approximately equal to but may be less than the length of a power or repositioning stroke of the respective jacking apparatus 20. Since each jacking apparatus 20 is substantially identical and functions in substantially the same manner, only one jacking apparatus will be described hereinafter. Means including pin 26 are provided for engaging the load 14 by the jacking apparatus 20. A load engagement means may comprise any kind of engaging mechanism by which the jacking apparatus 20 may engage a load 14 for movement in a desired direction. For example, a ram may be provided for pushing a load.

Shear members (not shown) may be welded to the deck 10 to transmit the jacking force from the launchways 12 to the deck. A launchway support may then be set between a pair of longitudinally-spaced shear members and restrained from vertical movement by hold-down members (not shown) which allow movement of the launchway support longitudinally to make contact with a shear member. The shear member then restrains the support against further longitudinal movement. The use of shear members thus simplifies the process of attachment of launchways to a deck and the disengagement thereof from a deck for attachment at another location on the deck.

Anchor point engagement means such as dogs 28 removably contained in one or more housings 32 are provided on the jacking apparatus 20 to engage respective anchor points 22 on the beams 16 so that the jacking apparatus 20 is restrained from movement and movement of the load 14 results when force is applied at the anchor points 22 in one longitudinal direction and which disengage the respective anchor points 22 so that the jacking apparatus may be moved when force is applied at the anchor points 22 in the opposite longitudinal direction. As shown in FIG. 2 wherein dogs 28 are shown removed from housings 32 and oriented for insertion in apertures 33 of respective housings 32, these dogs 28 may be characterized by longitudinally beveled bottom surfaces 36. Conventional gin pole sockets 29 may be provided for mounting of hoisting apparatus (not shown) to assist in removing and inserting the dogs 28. These dogs 28 may be inserted into the respective apertures 33 with the lowest points 38 of the bottom surfaces 36 located nearest the load 14 as illustrated in FIG. 2 and with substantial portions of the respective bottom surfaces 36 thereof inserted beyond the bottoms of respective housings 32 and into engagement with respective anchor point slots 22 to provide resistance to movement of the jacking apparatus 20 in a direction toward the load 14 so that movement of the load 14 may be effected in the direction illustrated at 40. Inserted as illustrated in FIG. 2, the dogs 28 do not, however, resist movement of the jacking apparatus 20 in the direction 40 when force is applied to urge the jacking apparatus 20 in that direction. Instead, the dogs 28 disengage from the slots 22 and slide over the surface of the beams 16 to engage another set of slots longitudinally spaced therefrom. The dogs 28 shown in FIG. 2 may also be rotated 180 degrees before insertion into the respective apertures 33 and slots 22 so that the lowest points 38 are furthest from the load 14 to provide resistance to movement of the jacking apparatus 20 in a direction away from the load 14 so that movement of a load may be effected in the direction illustrated at 44. Although one type of anchor point and anchor point engagement means is described herein, other types may be provided, and these are also meant to come within the scope of this invention. For example, rack and pawl or caliper systems may be provided. In order to transmit force between anchor points 22 and the cylinder structure 50 in order to resist movement of the jacking apparatus 20, dog housings 32 are connected to the hydraulic cylinder structure 50 by means such as through pin 58 and members 59.

In a situation where the jacking apparatus 20 is being utilized to push a load 14 such as in direction 44 in FIG. 1, it may be desirable to not attach the apparatus 20 to the load 14. In other words, it may be desired that the load 14 remain free of any attachment to the jacking apparatus 20 and be pushed by a ram attached to the piston rod structure. In such a case, dogs 28 may be inserted into respective apertures 33 of housing 32 and corresponding slots 22 with the lowest points 38 of the respective bottom surfaces 36 furthest from the load 14. During a power stroke, the load 14 may be pushed in direction 44 while the cylinder structure 50 may be held stationary by dogs 28. In accordance with a preferred embodiment of this invention, piston rod portion 46 of hydraulic cylinder structure 50 is connected to one side of another housing 30 through means such as pin 52. Removable dogs 34, similar to dogs 28, are inserted in respective apertures 31 in housing 30. These dogs 34 may be inserted into housing 30 and respective slots 22 with the lowest points 39 of the respective bottom surfaces 37 furthest from the load 14 to provide a means for anchoring the piston rod structure against movement on a repositioning stroke when the load is not attached to the piston rod structure or is too light to anchor the piston rod structure against movement. Housing 30 may be connected to the load 14 through pin 26 for transmitting the force between the piston rod portion 46 and the load 14.

Figure 5:
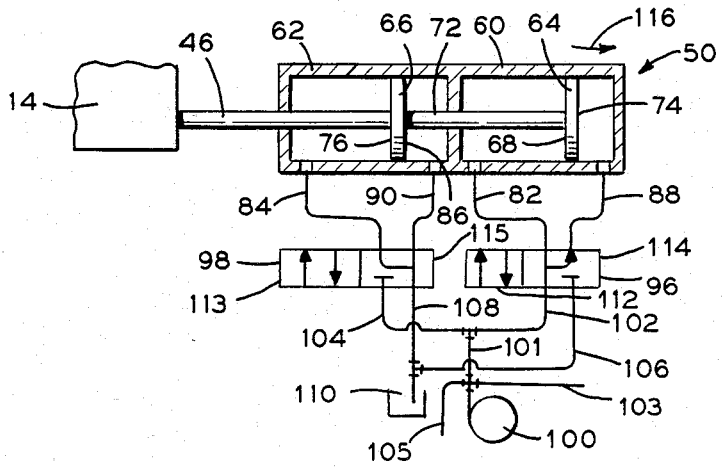
FIG. 5 is a schematic of a cylinder and hydraulic fluid supply and return arrangement for the jacking apparatus of FIG. 1.

To provide increased output force for a particular size cylinder bore the jacking apparatus cylinder structure 50 is provided, as illustrated in FIG. 5, with a group of at least two double-acting hydraulic cylinders including at least one first cylinder 60 and at least one second cylinder 62 arranged in tandem. Each of these cylinders 60 and 62 is supplied with a piston 64 and 66 respectively. By a "double-acting cylinder" is meant a cylinder and piston combination in which hydraulic fluid pressure may be applied to the piston on either side thereof. By a "tandem cylinder arrangement" i meant two or more cylinders which are mounted in line with pistons thereof connected by a common piston rod arrangement. In order to permit double acting operation of the cylinders 60 and 62, conventional rod seals (not illustrated) may be installed between them. As shown in FIG. 5, piston rod portion 46 extends to a first side 76 of the respective piston 66 of second cylinder 62. Another piston rod portion 72 extends from a second side 86 of the second cylinder piston 66 to a first side 68 of the respective piston 64 of first cylinder 60.

A tandem cylinder arrangement as described above may be considered desirable in a situation where the maximum working pressure is limited to develop a required output force which could not be developed otherwise with a single cylinder of the same bore size. For example, a cylinder with a piston area of 15 sq. in. (97 sq. cm.) may be the largest bore size which can be physically mounted on a particular machine. Yet the maximum working pressure available may only be 500 lbs. per sq. in. (35.2 kg. per sq. cm.) and the machine may be required to move a load which offers a resistance of 10,000 lbs. (4536 kg.). A tandem cylinder arrangement can be used in this situation which arrangement is made up of two cylinders with 15 sq. in. (97 sq. cm.) area pistons and 3 sq. in. (19 sq. cm.) area pistons rods. With 500 lbs. per sq. in. acting on a 15 sq. in. area of one piston and a 12 sq. in. area of the other piston, 13,500 lbs. (6124 kg.) of force is developed to move the load which force is more than adequate to move the 10,000 lb. (4536 kg.) load.

A hydraulic fluid supply means such as a hydraulic pump 100 provides hydraulic fluid pressure at a predetermined flow rate to the group of hydraulic cylinders 60 and 62. Since more than one group of hydraulic cylinders may be supplied by a single hydraulic pump, the predetermined flow rate to the group of hydraulic cylinders 60 and 62 may be less than the total output flow rate of the pump. For example, if a single pump supplies two groups of hydraulic cylinders equally, then the predetermined flow rate of hydraulic fluid to a group of hydraulic cylinders would be substantially half of the total output flow rate of the pump. By flow rate is meant the volume of fluid which flows to or past a given location per unit of time such as the number of gallons per minute of hydraulic fluid flowing past a junction in a line. This line may then have branches leading from the junction to each of a group of hydraulic cylinders.

Means are provided for allocating the predetermined flow rate of hydraulic fluid between hydraulic cylinders 60 and 62 and routing the allocated flow rates of hydraulic fluid to provide hydraulic fluid pressure to both of the pistons 64 and 66 for a power stroke to provide a maximum amount of force for movement of a load in a desired direction. In order to provide an increased flow rate of hydraulic fluid to one of the group of cylinders 60 and 62 for a faster repositioning stroke, means are provided in accordance with this invention for routing substantially all of the predetermined flow rate of hydraulic fluid to only one of the group of cylinders 60 and 62. By "substantially all of the predetermined flow rate" is meant, for the purposes of this specification and the claims, at least 75% of the predetermined flow rate. For example, 596 of the predetermined flow rate may be diverted such as to the other cylinder and the apparatus is still meant to come within the scope of the claims. Means are also preferably provided for preventing vacuum build-up in the cylinder to which hydraulic fluid pressure is restricted or excluded during the repositioning stroke.

Figure 3:
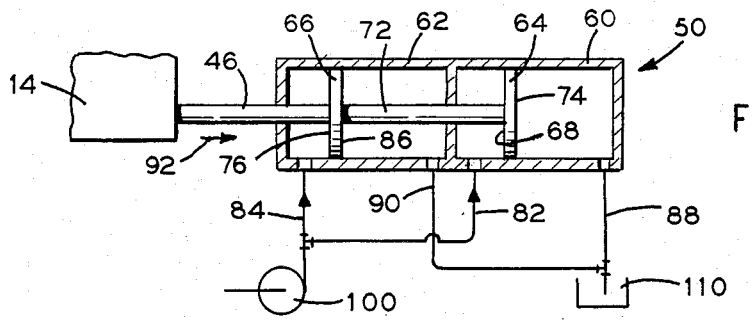
FIG. 3 is a schematic of a cylinder arrangement for the jacking apparatus of FIG. 1 illustrating the flow of hydraulic fluid to and from the cylinders during a power stroke.

Referring to FIG. 3, in accordance with a preferred embodiment of this invention, hydraulic fluid pressure is applied to first sides 68 and 76 of both pistons 64 and 66 respectively through fluid lines 82 and 84 respectively and hydraulic fluid may be evacuated from second sides 74 and 86 of both pistons 64 and 66 respectively through fluid lines 88 and 90 respectively for a power stroke to effect movement of the load 14 in the longitudinal direction illustrated at 92 whereby the cylinders 60 and 62 are restrained from movement by the anchor point engagement means and the pistons 64 and 66 are moved in direction 92.

Figure 4:
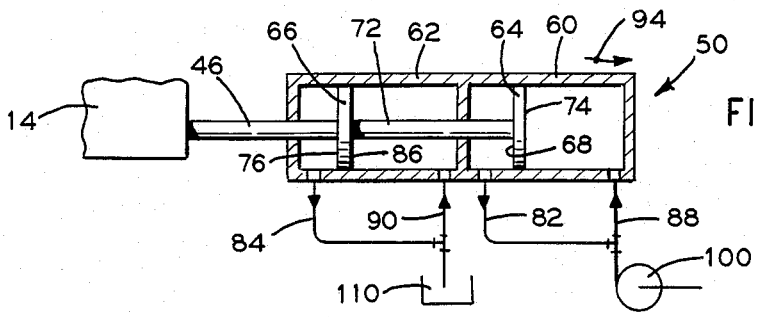
FIG. 4 is a schematic similar to FIG. 3 illustrating the flow of hydraulic fluid to and from the cylinders during a repositioning stroke.

Referring to FIG. 4, in order to increase the flow rate of hydraulic fluid into a cylinder for a faster repositioning stroke, hydraulic fluid pressure is applied in accordance with this invention to the second side 74 of the first cylinder piston 64 through line 88 while application of hydraulic fluid pressure to the second side 86 of the second cylinder piston 66 is at least restricted and preferably excluded whereby movement of the cylinders 60 and 62 in the direction 94 results since the anchor point engagement means disengage the anchor points for a repositioning stroke. Meanwhile, hydraulic fluid on the first sides 68 and 76 of pistons 64 and 66 respectively may be evacuated through lines 82 and 84 respectively.

Although fluid evacuated from the first side 68 of piston 64 through line 82 may be rounted to a sump if desired, it is preferably routed to line 88 to provide an even faster flow rate of hydraulic fluid to the second side 74 of piston 64 for an even faster repositioning stroke. It can be seen in FIG. 4 that during such a repositioning stroke, pressure is being applied to both sides of the first cylinder piston 64 at the same time. Although this may give the appearance of causing a hydraulically locked cylinder, the difference between the piston area on the first side 68 exposed to the hydraulic pressure and the piston area on the second side 74 exposed to the hydraulic pressure results in a larger force being applied on the second side 74 of the piston 64 for movement of the cylinders 60 and 62 in direction 94. Since the cylinder volume on the first side 68 of first cylinder piston 64 will therefore decrease, evacuation of fluid from the first side 68 of the first cylinder piston 64 will result, and this evacuated fluid will therefore be forced into line 88 to thereafter be merged with hydraulic fluid being supplied to the second side 74 of the first cylinder piston 64 by pump 100.

In order to prevent the speed of the repositioning stroke from being slowed or stopped due to vacuum build-up on the second side 86 of the second cylinder piston 66, the second side 86 of the second cylinder piston 66 is preferably connected to the first side 76 of the second cylinder piston 66 through lines 84 and 90, or to sump 110, or to both as shown in FIG. 4.

FIG. 5 illustrates a preferred means for providing the power and repositioning strokes illustrated in FIGS. 3 and 4. Such means include directional valves 96 and 98 to serve first and second cylinders 60 and 62 respectively. Hydraulic fluid supply means such as pump 100 provides hydraulic fluid pressure at a predetermined flow rate to the group of hydraulic cylinders 60 and 62 through line 101. Branch lines 102 and 104 extend from line 101 to directional valves 96 and 98 respectively. Pump 100 may also provide hydraulic fluid pressure at additional flow rates to other groups of hydraulic cylinders such as through lines 103 and 105. Branch lines 106 and 108 connect to directional valves 96 and 98 respectively for evacuation of fluid to sump 110. Each directional valve 96 and 98 has a power stroke position illustrated at 112 and 113 respectively and a repositioning stroke position illustrated at 114 and 115 respectively. The directional valves 96 and 98 are illustrated in the repositioning stroke position in FIG. 5 for movement of the cylinders 60 and 62 in the direction illustrated at 116.

Power stroke positions 112 and 113 connect respective lines 102 and 104 with respective lines 82 and 84 to allocate the predetermined flow rate of hydraulic fluid flowing from pump 100 through line 101 between hydraulic cylinders 60 and 62 and to route the allocated flow rates of hydraulic fluid to respective first sides 68 and 76 of respective pistons 64 and 66. As further shown in FIG. 5, power stroke positions 112 and 113 preferably connect respective lines 88 and 90 with lines 106 and 108 respectively leading to sump 110 to evacuate hydraulic fluid from the respective sides 74 and 86 of respective pistons 64 and 66.

In accordance with a preferred embodiment of the invention, repositioning stroke position 115 closes or blocks off line 104 to exclude flow of hydraulic fluid through line 104 to second cylinder 62 and repositioning stroke position 114 connects line 102 with line 88 to thereby route all of the predetermined flow rate of hydraulic fluid flowing in line 101 to the second side 74 of the first cylinder piston 64 for a repositioning stroke. As illustrated in FIG. 5, repositioning stroke position 114 also preferably routes the flow of hydraulic fluid in line 82 which is evacuated from the first side 68 of the first cylinder piston 64 into line 88 for an even faster repositioning stroke.

As further illustrated in FIG. 5, repositioning stroke position 115 also preferably connects line 90 with line 84 and with line 108 to sump 110 to prevent vacuum build-up on the second side of the second cylinder piston 66 during a repositioning stroke.

Figure 6:
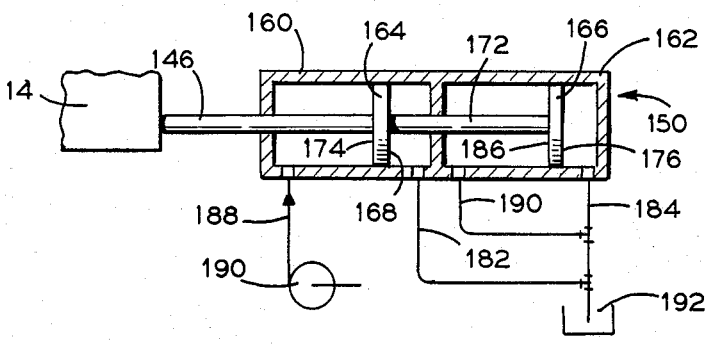
FIG. 6 is a schematic similar to FIG. 4 illustrating an alternative embodiment of this invention.

FIG. 6 illustrates a repositioning stroke for an alternative embodiment of this invention wherein an hydraulic cylinder structure 150 is illustrated which is similar to hydraulic cylinder structure 50 of FIG. 4. The hydralic cylinder structure 150 is provided with first and second double-acting hydraulic cylinders 160 and 162 arranged in tandem and having pistons 164 and 166 respectively connected by piston rod portion 172. However, in this embodiment, a piston rod portion 146 extends from a second side 174 of the first cylinder piston 164 to transmit force between the cylinder structure 150 and the load 14. Hydraulic fluid pressure at a predetermined flow rate is supplied by pump 190, similar to pump 100 of FIG. 4, to the hydraulic cylinder structure 150. In this embodiment, all of the predetermined flow rate of hydraulic fluid is supplied to the second end 174 of the first cylinder piston 164 through line 188 and hydraulic fluid is excluded from flow to the second cylinder 162 for increased repositioning stroke speed while hydraulic fluid is evacuated from first sides 168 and 176 of respective pistons 164 and 166 through respective lines 182 and 184 to sump 192, similar to sump 110 of FIG. 4. The second side 186 of second cylinder piston 166 is connected through line 190 to sump 192 and to the first side 176 of second cylinder piston 166 to prevent vacuum build-up.

Certain features of this invention may sometimes be used to advantage without a corresponding use of the other featues. It is also to be understood that the invention is by no means limited to the specific embodiments which have been illustrated and described herein, and that various modifications thereof may indeed be made which come within the scope of the present invention as defined by the appended claims.

What is claimed is

1. A jacking apparatus for effecting movement of a load in a direction along a member which has a plurality of anchor points spaced apart in said direction, the jacking apparatus comprising a group of at least two double-acting hydraulic cylinders including at least one first cylinder and at least one second cylinder arranged in tandem, an hydraulic fluid supply means to provide hydraulic fluid pressure at a predetermined flow rate to said group of hydraulic cylinders, a piston in each of said cylinders, the first cylinder piston has a first side and a second side, a piston rod portion connected to one of said pistons for transmitting force between said pistons and a load, another piston rod portion extending between said pistons, said second side of said first cylinder piston is free of attachment of any piston rod portion, means for routing hydraulic fluid to respective first sides of said pistons to apply hydraulic fluid pressure to said pistons in a first direction, means for routing substantially all of said predetermined flow rate of hydraulic fluid to said second side of said piston of said first cylinder to apply hydraulic fluid pressure to said first cylinder piston in a second direction, means for routing hydraulic fluid from said first side to said second side of said first cylinder piston while hydraulic fluid pressure is being applied to said first cylinder piston in said second direction, and at least one anchor point engagement means to engage an anchor point in the member for movement of a load when hydraulic fluid pressure is applied to said pistons in said first direction and to disengage an anchor point in the member for movement of said cylinders when hydraulic fluid pressure is applied to said first cylinder piston in said second direction.

2. A jacking apparatus according to claim 1 further comprising means for preventing vacuum build-up on a second side of said piston of said second cylinder when pressure is applied to said first cylinder piston in said second direction.

3. A jacking apparatus according to claim 1 wherein said means for routing substantially all of said predetermined flow rate of hydraulic fluid to said second side of said first cylinder piston comprises a first valve means for directing flow of hydraulic fluid from said supply means to said second side of said first cylinder piston, and a second valve means for excluding flow of hydraulic fluid from said supply means to said second cylinder whereby all of said predetermined flow rate of hydraulic fluid is routed to said second side of said first cylinder piston.

4. A jacking apparatus according to claim 1 wherein each of said first cylinder and said second cylinder has a bore size, and the bore size of said first cylinder is equal to the bore size of said second cylinder.

5. A method for effecting a repositioning stroke of a jacking cylinder having a double-acting tandem cylinder arrangement including at least one first cylinder and at least one second cylinder, a piston in each of the cylinders, a piston rod portion extending to one of the pistons, another piston rod portion extending between said pistons, and the second side of the first cylinder piston is free of attachment of any piston rod portion, the method comprising: supplying hydraulic fluid pressure at a predetermined flow rate to the tandem cylinder arrangement; routing substantially all of the predetermined flow rate of hydraulic fluid to a second side of the piston of said first cylinder; and routing fluid evacuated from the first side of the first cylinder piston to the second side of the first cylinder piston simultaneously with the routing of hydraulic fluid to the second side of the first cylinder piston.

6. A method according to claim 5 further comprising preventing vacuum build-up on a second side of the piston of said second cylinder.

7. A method according to claim 5 further comprising sizing the cylinders so that the bore size of the first cylinder is equal to the bore size of the second cylinder.

* * * * *